United States Patent [19]

Armstrong

[11] Patent Number: 4,927,046

[45] Date of Patent: May 22, 1990

[54] HOLDING VESSEL WITH SUPPORTIVE HANDLE

[76] Inventor: Robert E. Armstrong, 118 Chestnut Ave., Medford, Oreg. 97501

[21] Appl. No.: 194,189

[22] Filed: May 16, 1988

Related U.S. Application Data

[63] Continuation-in-part of Ser. No. 645, Jan. 5, 1987, abandoned.

[51] Int. Cl.[5] ..... A47G 19/22

[52] U.S. Cl. ..... 220/90

[58] Field of Search ..... 200/94 R, 90; 220/83, 220/90, 94 R

[56] References Cited

U.S. PATENT DOCUMENTS

| | | | |
|---|---|---|---|
| 1,590,572 | 6/1926 | Fredette | 220/90 X |
| 1,734,976 | 11/1929 | McClellan | 220/90 |
| 2,259,927 | 10/1941 | Dunton | 220/90 X |
| 3,595,431 | 7/1971 | Bird | 220/90 |
| 4,112,916 | 9/1978 | Guibert | 220/DIG. 13 X |
| 4,203,537 | 5/1980 | McAlister | 220/90 X |
| 4,235,348 | 11/1980 | Watson | 220/DIG. 5 X |
| 4,491,234 | 1/1985 | Vilcock | 220/90 |

*Primary Examiner*—Steven M. Pollard

[57] ABSTRACT

A vessel for carrying liquids or other loose materials is provided comprising a generally pentagonal, hollow body. The body of the vessel has an open top, convenient pouring spouts, and supportive handle which is an integral part of the lower half of one side of the body. The inner cavity of the body of the vessel is formed into a ledge at the top of the handle which, in conjuction with the notched spout directly opposite, provides an excellent paint brush holder. Three ridges in the bottom aid in cleaning one's paintbrush like a wash-board and serve as a place to grip with one's fingers when holding the bucket.

It is designed to be light-weight, comfortable, and versatile. It is specially designed as a paint bucket by virtue of its built-in brush holder, the ease with which it can be cleaned, and its pouring spouts. It also could serve well as a fruit-picking bucket, an efficient bucket for bailing water out of a boat, a bucket for household cleaning, a trick-or-treat collector, a hair rinsing bucket, or for transfering larger volumes of liquid or other loose materials to smaller containers.

1 Claim, 2 Drawing Sheets

HOLDING VESSEL WITH SUPPORTIVE HANDLE

CROSS REFERENCES

This application is a continuation in part of my first application. Ser. No.: 07/000,645 filing date: 01/05/87 now abandoned.

BACKGROUND OF THE INVENTION

This invention relates to vessels for carrying or holding liquids or other loose materials such as fruit, lawn seed, flour, sand, etc.; and more specifically it relates to a hand-held vessel for holding paint and paint brush. It also would be useful for picking fruit, bailing water out of a boat, holding and transporting a variety of liquids, and for transfering liquids or loose materials from one container to another since it has pouring spouts specially suited for this purpose.

In the field of painting with a brush and bucket, there has long been a problem as to how to comfortably hold and carry a quantity of paint and a paint brush for an extended period of time and over precarious terrain—such as while climbing a ladder, working off of a scaffold, or while standing on the roof of a building. One approach to this problem has been to use a lightweight paper bucket capable of holding around a gallon of paint. These buckets, however, have no handle and must be gripped with the thumb and fingers by the rim and side—which is tiring—or they must be cradled against ones body in the crook of ones arm—which is inconvenient. Another approach to the problem is to use a metal or plastic bucket with a bail-type handle. This approach, while affording a more versatile mode of holding a paint bucket, is awkward for dipping a paint brush into the paint when the bucket is being suspended from the handle since ones hand tends to be in the way. An alternative mode for holding this type of bucket is to support the bottom of the bucket with the palm and fingers of ones hand, and to hook one's thumb into the bail-type handle as it hangs down along the side of the bucket. This alternative, however, can be unsatisfactory since it tends to cause a great deal of muscle fatigue in the hand supporting the paint bucket.

In regard to the task of keeping track of ones paint brush and setting it down in a well cared for manner, the main approach has been to balance it across the top of whatever type of paint bucket one happens to be using. This, however, is not a stable resting place for a paint brush and it is vulnerable to being knocked off or falling into the paint bucket. Also, this method may let paint drip down the outside of the bucket, making a mess on the outside of the bucket as well as on whatever happens to the resting place for the bucket. An alternative approach to this problem is to have a sheath that attaches to the side of the bucket for inserting the paint brush when it is not in use. This is not a good solution because a sheath of this sort tends to accumulate paint, and it deforms the bristles of a paint brush to have the paint brush standing on end. There is also the option of having a bucket with a bar across the inside a quarter of the way down for the brush bristles to rest on. This is not good however because the bristles get deformed in pressing against the rounded side of the bucket.

Another significant problem with painting is that of having a container for holding paint which can be held close to ones work so as to ease and speed up the process of painting.

There is also the problem of whether a paint bucket can be easily cleaned. Any paint bucket will clean easily if it is cleaned immediately after being used. But if the paint is allowed to stand in a bucket until it dries, cleaning the bucket may be quite difficult. A paper bucket can be thrown away if this occurs; but a metal, rubber, or heavy plastic pail may be very difficult to clean. Another problem is that of having a good place to clean ones paint brush if one is using an oil-base paint, and then how to dispose of the dirty thinner.

In regard to the endeavor of picking fruit there have been similar problems to those encountered in painting with a brush and bucket. Namely, that the containers used for assisting in fruit picking are often awkward, tiring to hold, and difficult to hold close to where one is working. While most any type of bucket may be used for picking fruit, the ones available are difficult to hold close to ones work without exerting considerable effort.

In the area of devices for bailing water out of boats, anything at hand might do in an emergency, but an efficient, effortless device is not available.

Many of these needed features in a bucket, or others such as how to transfer material from one container to another without spilling, might be found to be useful in house cleaning, industrial cleaning, automotive upkeep, or other areas.

Accordingly, there exists a need for a convenient, light weight, comfortable, efficient, and economical device for carrying, holding, and transfering liquids or other loose materials. Also, there is a specific need, along with the afore mentioned capabilities, of providing a secure and convenient resting place for a paint brush, with the said resting place being an integral part of the body of a paint bucket. As will become apparent from the following, the present invention satisfies these needs.

SUMMARY OF THE INVENTION

The present invention resides in a new and improved vessel for carrying, holding and transfering liquids or other loose materials. It also is specially designed to serve as a paint bucket by virtue of its built-in brush-holder, its convenient pouring spouts, its spill resistant design, its cleaning and gripping ridge and its versatile handle.

More specifically, this holding vessel with supportive handle has its pouring spouts located at the center of the front of the vessel and at both sides. The center spout is designed to serve as a resting place for the handle of a paint brush by virtue of its shape, its being notched to keep the handle from sliding back and forth, and its juxtaposition to the ledge which the top of the built-in handle forms in the body of the container. The ledge is suited to support the bristles of a paint brush by virtue of its square and flat shape and its attitude relative to the front notched pouring spout which help to keep the brush's bristles from being disturbed. The ledge will accomodate a five inch brush, or smaller, without disturbing the bristles. The leading edge of the ledge may be used for wiping excess paint off of a paintbrush's bristles. The high sides of the vessel make the vessel especially spill resistant as a bucket.

The body of the holding vessel is made of polyethelyne or other suitable material—which is lightweight, flexable, durable, sanitary, tough and easily cleaned. The high side walls of the body of the vessel, as well as helping to prevent spillage of the vessel's contents, augment the holding capacity of the vessel. The body of the vessel is characterized by the pistol-grip, form-fitting handle which is located under the paintbrush resting ledge, just to the rear of the main compartment. The handle is designed with ample room for a man's hand, yet it is comfortable for a smaller hand as well. It is tilted at an angle which is comfortable for the way one would naturally hold the hand and wrist. The position of the handle relative to the body of the vessel provides excellent support for the weight of substance being held. The handle is placed between the middle and bottom of the vessel, and it places the user's hand and wrist near the center of the weight being held. The body of the vessel has a flat and broad base which provides a stable means of securely setting down the container and its contents.

The thinness of the walls of the bucket and the quality of the plastic material from which they are formed combine to aid in the cleaning of the bucket if layers of paint should happen to accumulate on the walls. The walls of the bucket can be bent back and forth until the paint or other accumulated material cracks, making it then possible to peel the layers off without damaging the bucket.

The ridges in the bottom of the bucket help one grasp the bucket with the tips of one's fingers when one is holding it with the palm and fingers under the base of the bucket and the thumb hooked through the handle. The ridges also are useful when cleaning a paint brush in the bucket since rubbing the brush over the ridges help to work the solvent into the bristles and remove the paint. It is also a good idea to use the paint brush to slosh the solvent around in the bucket and therby clean the bucket.

The present invention may serve well as a fruit-picking device because it is light-weight, comfortable to hold, sanitary and easy to hold close to where the fruit is being picked and can be used in conjunction with the free hand. It may serve well for bailing water out of a boat because it is light weight, it fits the hand so well, and because it is like a big scoop extension of the hand.

DETAILED DESCRIPTION

Figure 1:
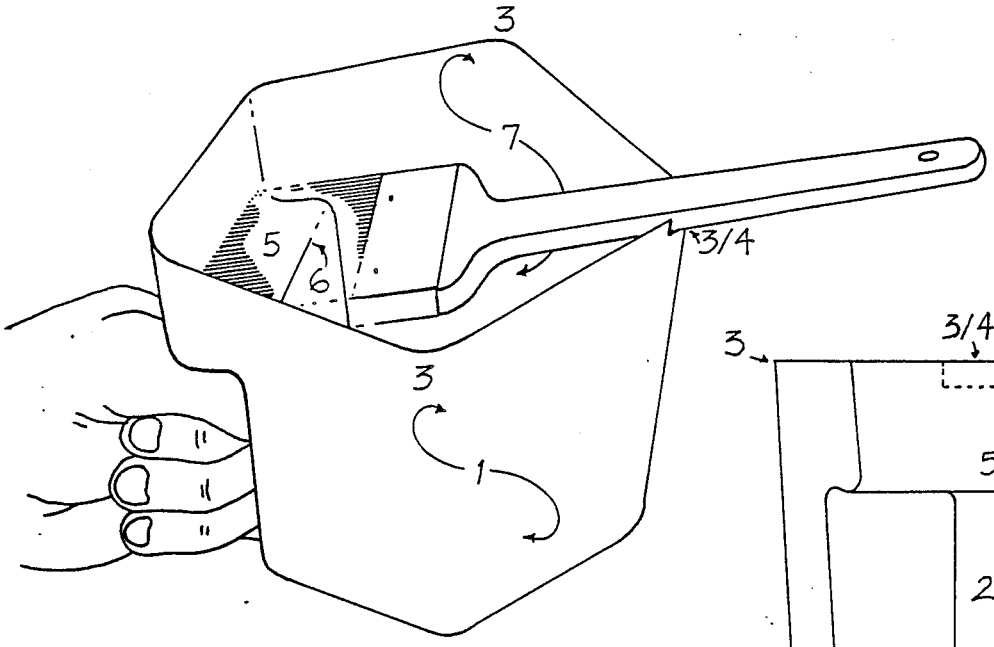
FIG. 1 Perspective drawing of the vessel with paint brush and held by the hand.
Figure 2:
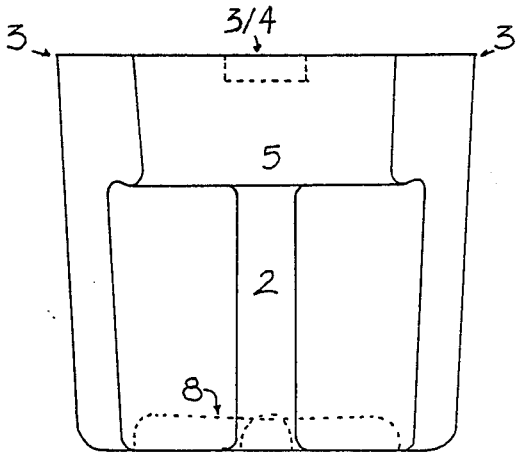
FIG. 2 Rear view of the holding vessel with supportive handle.
Figure 3:
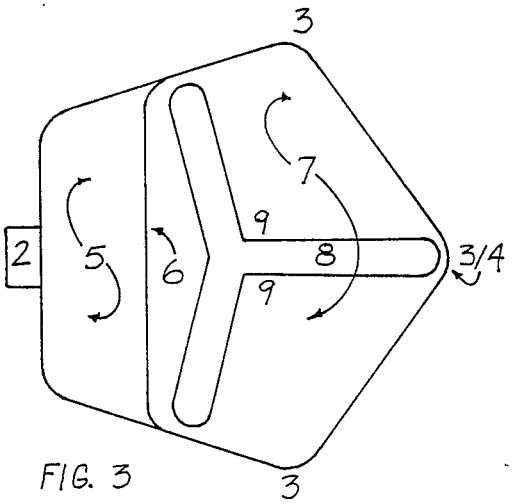
FIG. 3 Top view of the vessel.
Figure 4:
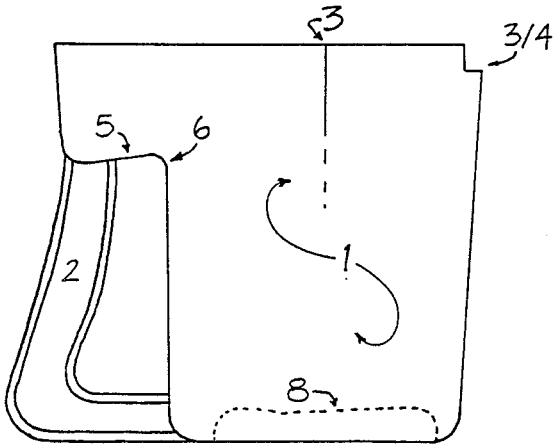
FIG. 4 Side view of the holding vessel with supportive handle.
Figure 5:
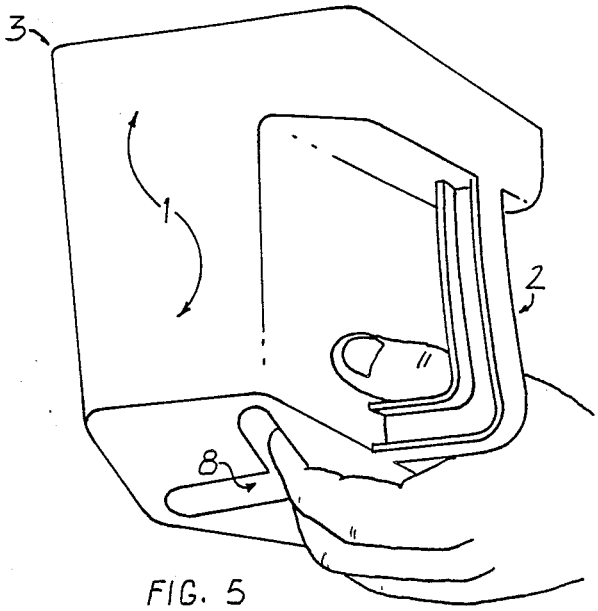
FIG. 5 Perspective view of bottom of vessel showing how ridges help in gripping.
Figure 6:
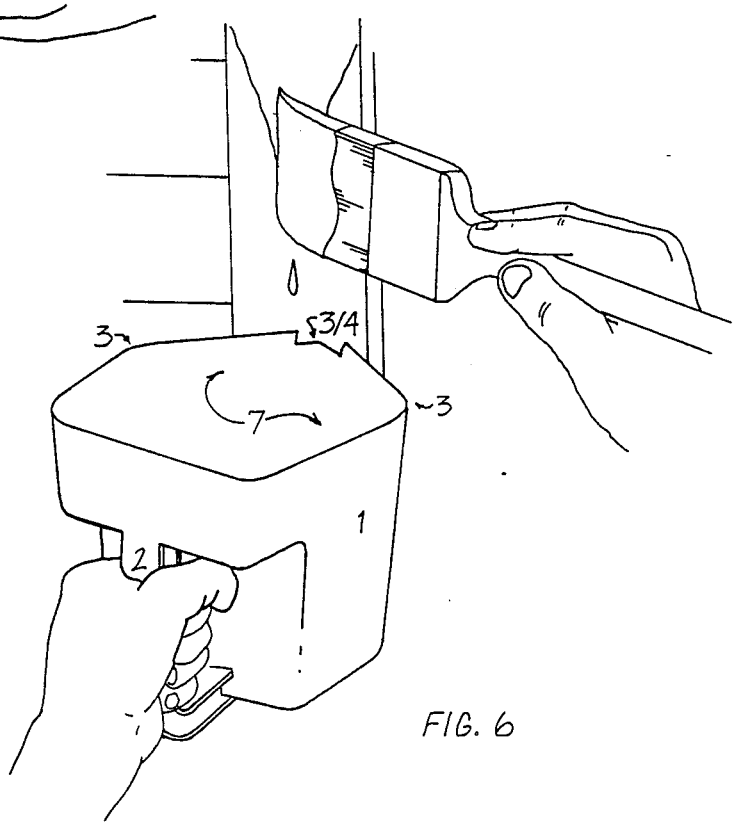
FIG. 6 Perspective view of vessel in use.

As shown in the exemplary drawings, the present invention is a vessel which is adapted for carrying, scooping, pouring and holding various liquids such as paint, water, cleaning fluids, etc., and it is also adapted to doing the same for loose solids such as sand, flour, fertilizer, lawn seed, etc. In this instance, the vessel is comprised of a generally pentagonal, squat body portion, 1 which includes a handle 2 for conviently holding the vessel.

The distinctive features of this holding vessel with handle are that it has convenient pouring spouts 3 located at the center of the front of the body 1 of the vessel, and at both sides. The spouts 3 are further adaptable to pouring liquids accurately by virtue of the fact that the walls of the body 1 are thin and flexible and can be pinched in order to form a better spout. Yet the material is rigid enough to maintain its original shape. The center spout 4 is designed to serve as a resting place for the handle of a paint brush by virtue of its shape, its notch 4 to keep the handle of a paintbrush from sliding back and forth and its juxtaposition to the ledge 5. A paint brush can easily span the distance between the ledge 4 and the center spout 3, and the ledge 4 is suited to support the bristles of a paint brush by virtue of its square and flat shape which helps to keep from disturbing the bristles. The ledge 4 will accomodate a 5" brush, or smaller without disturbing the bristles. The leading edge 5 of the ledge 4 may be used for wiping excess paint off of the brushes' bristles. The higher outer walls of the vessel make an excellent safeguard against spilling the contents of the vessel.

The body 1 of the holding vessel is made of polyethelyne or other suitable material—which is lightweight, flexible or rigid, durable, tough, sanitary, and easily cleaned. The high outer walls of the vessel, along with helping to prevent spillage, also augment the holding capacity of the vessel. The body 1 of the holding vessel is most distinctly characterized by the form-fitting, pistol-grip handle 2 which is located under the ledge 5, just to the rear of the main compartment 7. The handle 2 is large enough to accomodate most anyone's hand, and it is tilted at an angle which is comfortable for the way one would naturally hold the hand and wrist. The handle 2 is substantial so that one has plenty to hold on to if one is holding the vessel for an extended period of time. The position of the handle 2 relative to the body 1 of the vessel provided excellent support even when a considerable weight is being held. The handle 2 is near the bottom of the vessel and it is in such a position that it puts ones hand near the center of the weight being held.

The ridges 8 in the bottom of the vessel help in the cleaning of paint brushes, add rigidity and strength to the vessel, and allow one to grip ones fingers in them when holding the bucket by the bottom instead of by the handle. All these features, the comfortable handle, the position of the handle, and the ridges for gripping contribute to making the vessel especially easy to hold near one's work.

I claim:

1. A holding vessel, having a base, a body having a pentagonal cross-sectional shape in a plane parallel to said base, a supportive handle, and an upper rim comprising:

said vessel having a ledge, located between the base and the upper rim, formed by an inset in the sidewall below the ledge, said sidewall extending from the base to an inner edge of the ledge and from an outer edge of the ledge to the upper rim;

said upper rim being of pentagonal shape, the corners of said upper rim being rounded and flexible in order to form left, right, and front-end pouring spouts;

said front-end pouring spout being located opposite said ledge and having a notch to keep the handle of a paint brush from sliding back and forth, and in conjunction with the opposing ledge, forming a built-in paint brush holder;

said supportive handle, located in the middle of one of the five sides of the body of the vessel and on the same side as the ledge, beginning at the base of the vessel, extending outwardly parallel to said base, then upwardly, generally parallel to said sidewall and intersecting said ledge, said handle being an integral part of the body of the vessel;

said handle angling away from the body of the vessel in a pistol-grip fashion;

the body of the vessel above the ledge and handle and extending to the rim being thicker and more rigid than the rest of the body;

said base having three low, narrow ridges extending inwardly therefrom.

* * * * *